US007517189B2

(12) United States Patent
Camus

(10) Patent No.: US 7,517,189 B2
(45) Date of Patent: Apr. 14, 2009

(54) COOLING CIRCUIT FOR GAS TURBINE FIXED RING

(75) Inventor: Stephane Camus, Alfortville (FR)

(73) Assignee: SNECMA, Paris (FR)

( * ) Notice: Subject to any disclaimer, the term of this patent is extended or adjusted under 35 U.S.C. 154(b) by 488 days.

(21) Appl. No.: 10/557,203

(22) PCT Filed: Jul. 8, 2004

(86) PCT No.: PCT/FR2004/001785

§ 371 (c)(1),
(2), (4) Date: Nov. 17, 2005

(87) PCT Pub. No.: WO2005/008033

PCT Pub. Date: Jan. 27, 2005

(65) Prior Publication Data

US 2007/0041827 A1 Feb. 22, 2007

(30) Foreign Application Priority Data

Jul. 10, 2003 (FR) ..... 03 08483

(51) Int. Cl.
*F03B 11/00* (2006.01)

(52) U.S. Cl. ..... 415/173.1; 415/175

(58) Field of Classification Search ..... 415/108, 415/116, 173.1

See application file for complete search history.

(56) References Cited

U.S. PATENT DOCUMENTS 4,222,707 A * 9/1980 Drouet et al. ..... 415/116
4,329,113 A 5/1982 Ayache et al.
4,468,168 A * 8/1984 Aubert ..... 415/116
4,573,866 A * 3/1986 Sandy et al. ..... 415/116
4,650,395 A * 3/1987 Weidner ..... 415/116
4,668,164 A * 5/1987 Neal et al. ..... 415/116
4,679,981 A * 7/1987 Guibert et al. ..... 415/116
5,486,090 A * 1/1996 Thompson et al. ..... 415/173.1
5,536,143 A 7/1996 Jacala et al.
5,538,393 A * 7/1996 Thompson et al. ..... 415/115
5,584,651 A * 12/1996 Pietraszkiewicz et al. ... 415/115
5,993,150 A * 11/1999 Liotta et al. ..... 415/115
6,139,257 A * 10/2000 Proctor et al. ..... 415/115

FOREIGN PATENT DOCUMENTS

EP 0 709 550 5/1996
FR 2 540 937 8/1984

* cited by examiner

*Primary Examiner*—Edward Look
*Assistant Examiner*—Aaron R Eastman
(74) *Attorney, Agent, or Firm*—Oblon, Spivak, McClelland, Maier & Neustadt, P.C.

(57) ABSTRACT

A stationary ring surrounding a hot gas passage in a gas turbine, the ring being surrounded by a stationary annular housing co-operating therewith to define an annular cooling chamber into which there opens out at least one cooling air feed orifice. The ring is made up of a plurality of ring segments, each ring segment including a top internal cooling circuit and a bottom internal cooling circuit. The bottom cooling circuit is independent of the top cooling circuit and is radially offset relative to the top cooling circuit.

13 Claims, 4 Drawing Sheets

COOLING CIRCUIT FOR GAS TURBINE FIXED RING

BACKGROUND OF THE INVENTION

The present invention relates to stationary rings surrounding gas passages in a gas turbine, and more particularly it relates to cooling stationary rings in a gas turbine.

A gas turbine, in particular a high pressure turbine of a turbomachine, typically comprises a plurality of stationary vanes alternating with a plurality of moving blades in the passage for hot gas coming from the combustion chamber of the turbomachine. The moving blades on the turbine are surrounded over their entire circumference by a stationary ring that is generally made up of a plurality of ring segments. These ring segments define part of the flow passage for hot gas passing through the blades of the turbine.

The ring segments of the turbine are thus subjected to the high temperatures of the hot gas coming from the combustion chamber of the turbomachine. To enable the turbine ring to withstand the temperature and mechanical stresses to which it is subjected, it is necessary to provide the ring segments with cooling devices.

One of the known methods of cooling consists in feeding cooling air to an impact plate mounted on the bodies of the ring segments. The plate is provided with a plurality of orifices for passing air which, under the pressure difference between the sides of the plate, comes to cool the ring segment by impact. The cooling air is then exhausted into the hot gas passage via holes formed through the ring segment.

Such a method does not enable effective and uniform cooling of the ring segments to be obtained, particularly at the upstream ends of the ring segments which constitute a zone that is particularly exposed to hot gas. This therefore has an affect on the lifetime of the ring segment. Furthermore, that technology requires too great an amount of cooling air to be taken, thereby decreasing the performance of the turbine.

OBJECT AND BRIEF SUMMARY OF THE INVENTION

The present invention thus seeks to mitigate such drawbacks by proposing a stationary ring for a gas turbine in which each ring segment is provided with internal cooling circuits that require only a small flow of air, and enabling the ring segment to be cooled effectively by thermal convection.

To this end, the invention provides a stationary ring surrounding a hot gas passage of a gas turbine, the ring being surrounded by a stationary annular housing so as to co-operate therewith to define an annular cooling chamber into which there opens out at least one cooling air feed orifice, the ring being made up of a plurality of ring segments, the ring being characterized in that each ring segment includes a top internal cooling circuit and a bottom internal cooling circuit, the bottom cooling circuit being independent of the top cooling circuit and being radially offset relative to the top cooling circuit.

The top and bottom internal cooling circuits benefit from high heat exchange coefficients in order to provide effective and uniform cooling of each ring segment. These circuits make it possible in particular to cool the ring segment zones that are the most exposed to the hot gas. It is thus possible to reduce the air flow needed for cooling the ring segments, even under severe thermodynamic conditions of turbine operation.

As a result, the lifetime of the stationary ring of the turbine can be increased and the performance of the turbine is little affected by the air that is taken for cooling the ring segments.

The top cooling circuit serves in particular to cool the upstream end of the ring segment and to improve the effectiveness of the bottom cooling circuit. The bottom cooling circuit serves to cool the inside surface of the ring segment, and possibly of the adjacent ring segments.

The top and bottom internal cooling circuits are independent of each other, which presents the advantages of enabling the cooling that is performed by each cooling circuit to be independent and of enabling the air flow fed to each circuit to be adapted thereto. For example, a large flow could be used for the top circuit in order to cool the upstream end of the ring segment effectively (i.e. the hottest zone thereof), while a smaller flow could be used for the bottom circuit. The independence between the cooling circuits also makes it possible to optimize cooling in independent manner.

BRIEF DESCRIPTION OF THE DRAWINGS

Other characteristics and advantages of the present invention appear from the following description given with reference to the accompanying drawings which show an embodiment that has no limiting character. In the figures.

DETAILED DESCRIPTION OF AN EMBODIMENT

Figure 1:
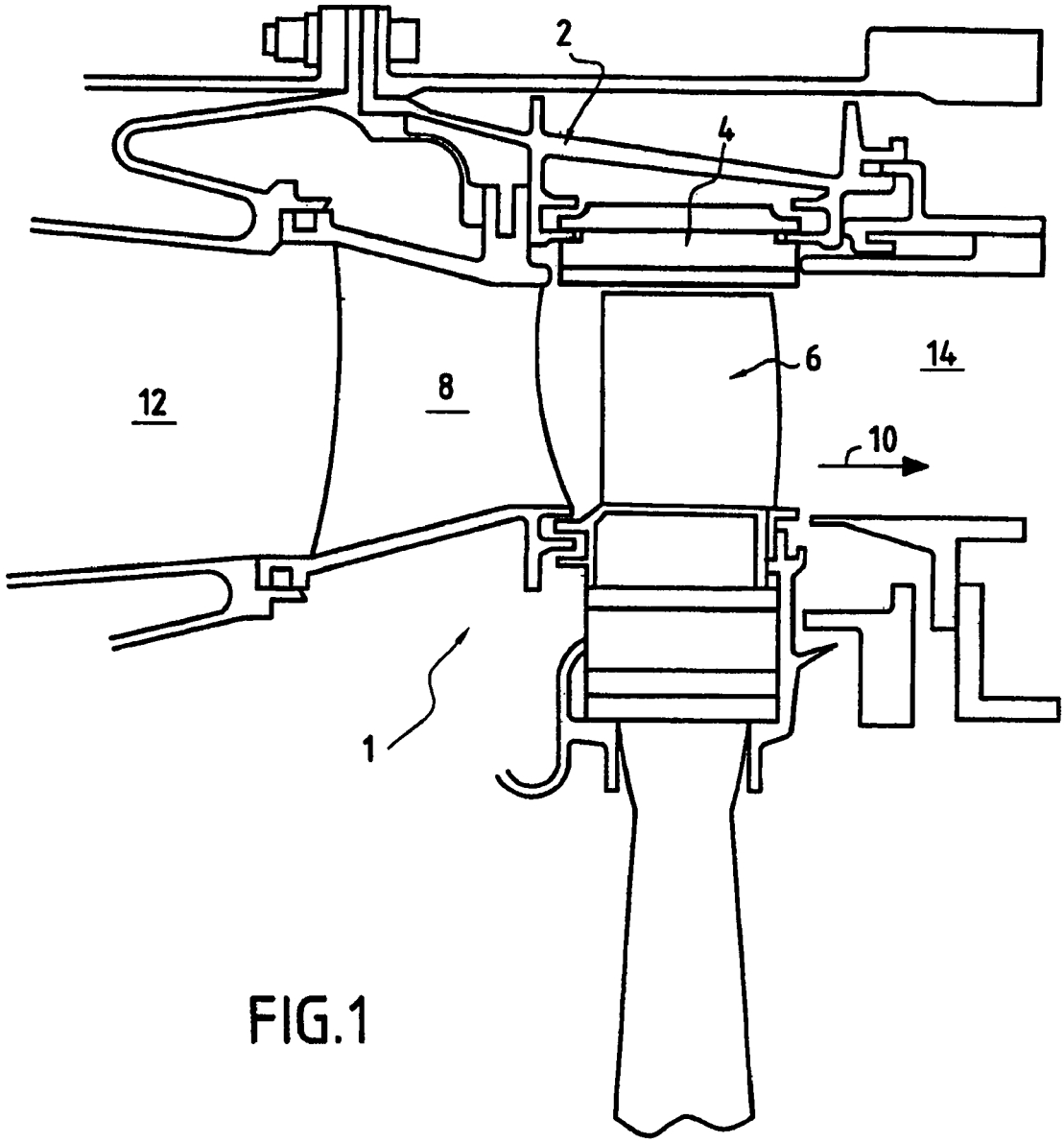
FIG. 1 is a diagram of a portion of a gas turbine showing the location of a stationary ring relative to the location of the moving blades.

Reference is made initially to FIG. 1 which is a diagram showing a portion of a high pressure turbine 1 of a turbomachine.

The high pressure turbine 1 includes in particular a stationary annular housing 2 constituting a casing of the turbomachine. A stationary turbine ring 4 is secured to the housing 1 and surrounds a plurality of moving blades 6 of the turbine. These moving blades 6 are disposed downstream from stationary vanes 8 relative to the flow direction 10 of the hot gas coming from a combustion chamber 12 of the turbomachine and passing through the turbine. Thus, the ring 4 of the turbine surrounds a flow passage 14 for hot gas.

In general, the turbine ring 4 comprises a plurality of ring segments disposed circumferentially around the axis of the turbine (not shown) so as to form a continuous circular surface. Nevertheless, it is also possible for the turbine ring to be constituted by a single continuous part. The present invention applies equally well to a single turbine ring and to a segment of a turbine ring.

Figure 2:
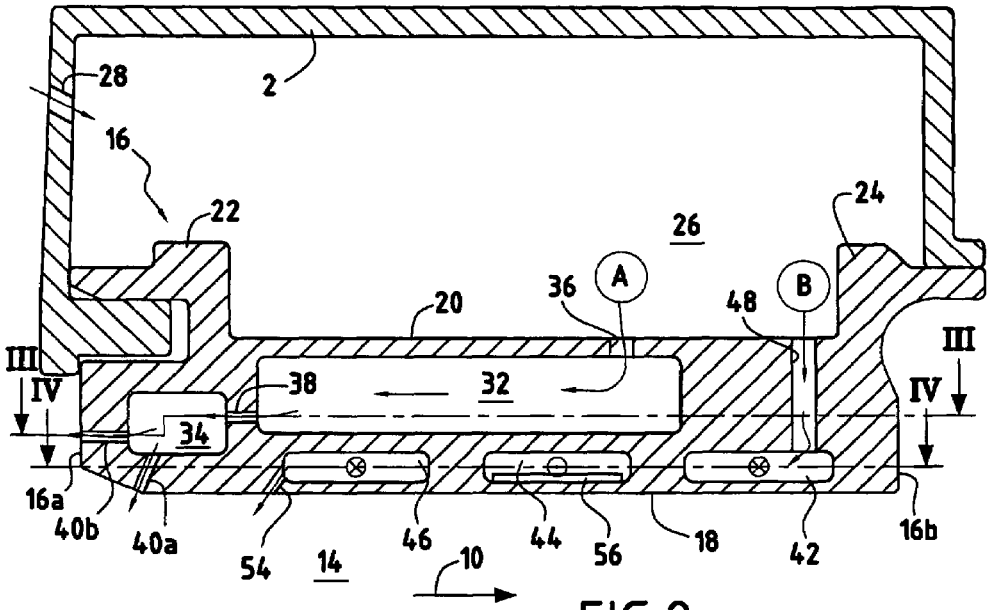
FIG. 2 is a longitudinal section view of a ring segment in an embodiment of the invention.

With reference to FIG. 2, it can be seen that each ring segment 16 forming the stationary ring presents an inner annular surface 18 and an outer annular surface 20 that is radially offset relative to the inner surface 18. The inner surface 18 faces the hot gas flow passage 14. Each ring segment 16 also presents, at its upstream transverse wall 16*a*, an upstream hook 22, and at its downstream transverse wall 16*b*, a downstream hook 24. The upstream and downstream hooks 22 and 24 enable the ring segment 16 to be secured to the stationary annular housing 2 of the turbine.

The stationary annular housing 2 and the turbine ring made up of the ring segments 16 define between them an annular cooling chamber 26 that is fed with cooling air via at least one orifice 28 passing through the stationary annular housing 2. The cooling air feeding this cooling chamber 26 typically comprises a fraction of the outside air passing through a fan and flowing around the combustion chamber of the turbomachine.

According to the invention, each ring segment 16 is provided with a top internal cooling circuit A and a bottom internal cooling circuit B, B', the bottom cooling circuit B, B' being independent of the top cooling circuit A and being radially offset relative thereto. These top and bottom cooling circuits A and B, B' serve to cool the ring segments by thermal convection.

More precisely, the top cooling circuit A is for cooling the outer annular surface 20 and the upstream end of the ring segment 16 which is the end of ring segment that is the most exposed to hot gas. The bottom cooling circuit B, B' serves to cool the inner annular surface 18 of the ring segment 16 which is the surface that is the most exposed to the stream of hot gas. The top cooling circuit A also makes it possible to improve the efficiency of the cooling performed by the bottom circuit B, B'.

An embodiment of the ring segment of the invention is described below with reference to FIGS. 2 to 4.

In these figures the top cooling circuit A comprises at least a first internal cavity 32 which extends circumferentially between longitudinal walls 16*c*, 16*d* of the ring segment 16. This first cavity 32 also extends over a fraction only of the axial length of the ring segment 16 defined between its upstream and downstream transverse walls 16*a* and 16*b*.

The top cooling circuit A also has at least one second internal cavity 34 extending circumferentially between the longitudinal walls 16*c* and 16*d* of the ring segment 16. This second cavity 34 is disposed axially upstream from the first cavity 32, i.e. between the upstream transverse wall of the first cavity 32 and the upstream transverse wall 16*a* of the ring segment 16. The axial length of the second cavity 34 (i.e. the distance between its transverse walls) is substantially smaller than that of the first cavity 32.

At least one cooling air feed orifice 36 leads from the cooling chamber 26 into the first cavity 32 in order to feed the top circuit A with cooling air. More precisely, this feed orifice 36 leads from the cooling chamber 26 into the downstream end of the first cavity 32.

A plurality of emission holes 38 are also provided leading from the first cavity 32 into the second cavity 34. These emission holes 38 enable the second cavity 34 to be cooled by air impact.

The top cooling circuit A also includes a plurality of outlet holes 40*a*, 40*b* leading from the second cavity 34 into the hot gas passage 14 at the upstream end of the ring segment 16. The cooling air flowing in the top circuit A is thus exhausted via these outlet holes 40*a*, 40*b*.

More precisely, a first series of outlet holes 40*a* is provided opening out into the hot gas passage 14 at the inner annular surface 18 of the ring segment 16, and a second series of outlet holes 40*b* is provided that open out into the hot gas passage 14 at the upstream transverse wall 16*a* of the ring segment. For this purpose, the outlet holes 40*a* in the first series may be inclined relative to the flow direction 10 of the hot gas, while the outlet holes 40*b* of the second series may be substantially parallel to said flow direction.

Naturally, it would also be possible for the top cooling circuit A to present other series of outlet holes opening out into the hot gas passage, at the upstream end of the ring segment 16.

Figure 3:
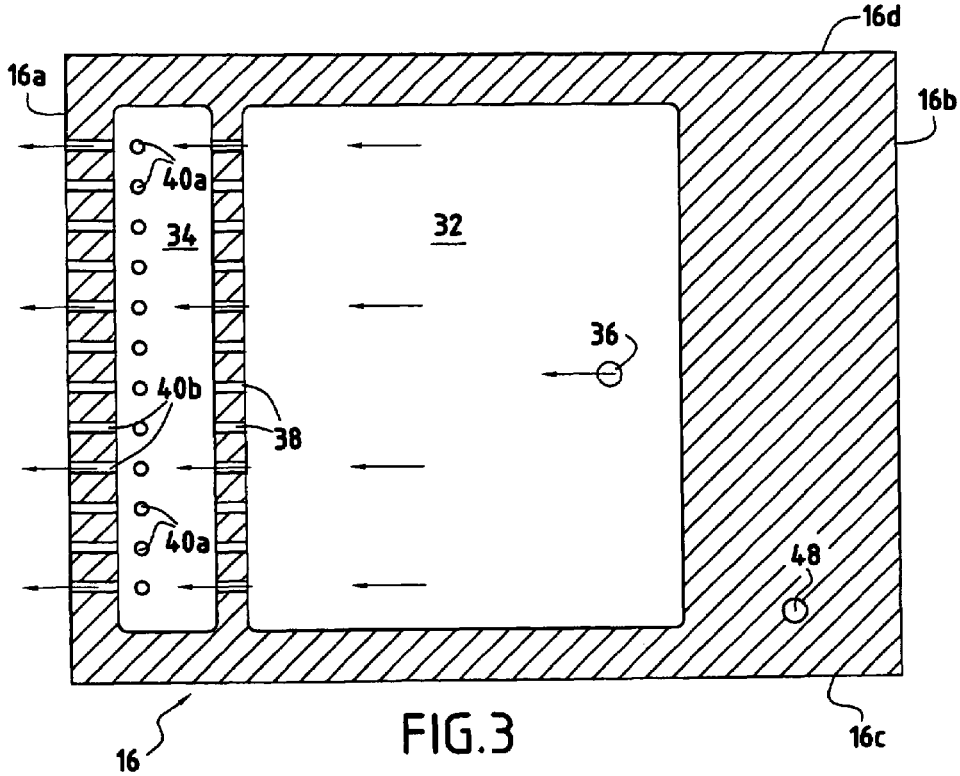
FIGS. 3 and 4 are two respective section views on planes III-III and IV-IV of FIG. 2.

It should also be observed that in FIG. 3 the outlet holes 40*a* and 40*b* are substantially in alignment on an axial direction relative to the emission holes 38 leading from the first cavity 32 into the second cavity 34. Such a disposition serves to reduce head losses. Nevertheless, it would also be possible for the outlet holes 40*a* and 40*b* not to be in alignment with the emission holes 38.

Figure 4:
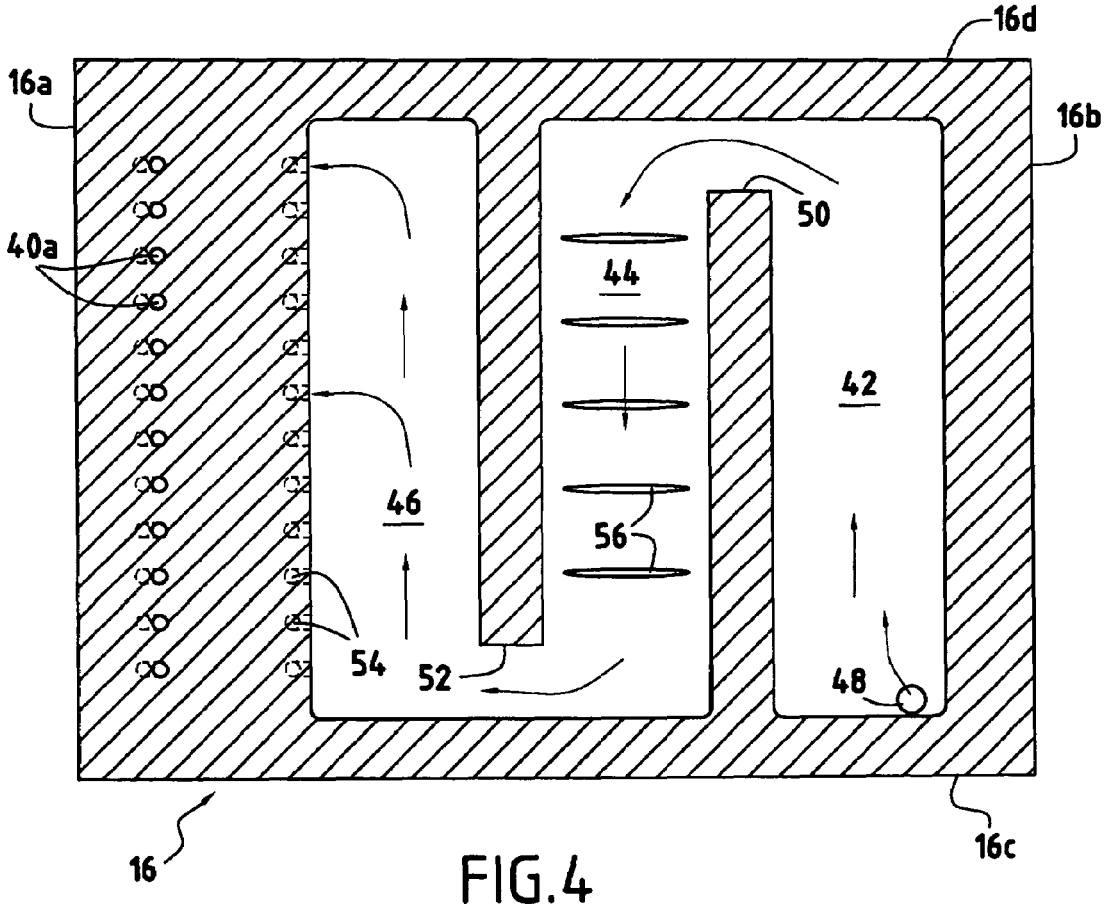

In the embodiment shown in FIGS. 2 to 4, the bottom internal cooling circuit B is provided with at least three internal cavities 42, 44, and 46 which extend circumferentially between the longitudinal walls 16*c* and 16*d* of the ring segment 16.

These three cavities 42, 44, and 46 are also radially offset relative to the first cavity 32 of the top cooling circuit A, i.e. they are disposed between the first cavity 32 of the top circuit A and the internal annular surface 18 of the ring segment 16.

More precisely, at least one first internal cavity 42 is disposed on the downstream end of the ring segment 16. At least one second internal cavity 44 is disposed axially upstream from the first cavity 42. Similarly, at least one third internal cavity 46 is disposed axially upstream from the second cavity 44.

It should be observed in FIGS. 2 and 4 that these three cavities 42, 44, and 46 are of axial lengths (i.e. the distance between their respective transverse walls) that are substantially identical and that they are spaced apart from one another at substantially equivalent distances.

The bottom cooling circuit B is fed with cooling air via at least one feed orifice 48 leading from the cooling chamber 26 into the first cavity 42.

The bottom cooling circuit B also has at least one first passage 50 putting the first cavity 42 into communication with the second cavity 44, and at least one second passage 52 putting the second cavity 44 into communication with the third cavity 46.

A plurality of outlet holes 54 lead from the third cavity 46 into the hot gas passage 14, at the upstream end of the ring segment 16 for the purpose of cooling it. The outlet holes 54 open out in the upstream end of the ring segment, through the internal annular surface 18 thereof. By way of example they are inclined relative to the flow direction 10 of the hot gas. The cooling air flowing in the bottom circuit B is thus exhausted via the outlet holes 54.

The second cavity 44 of the bottom cooling circuit B is preferably provided with baffles 56 so as to increase heat transfer. As shown in FIG. 4, these baffles 56 may be splines extending longitudinally perpendicularly to the air flow direction in the second cavity 44. These baffles may also take the form of studs or bridges, for example.

Advantageously, the air feed orifice 48 and the second passage 52 of the bottom circuit B are disposed beside one of the longitudinal walls 16*c* (or 16*d*) of the ring segment 16, while the first passage 50 of the bottom circuit B is disposed beside the other longitudinal wall 16*d* (or 16*c*) of the ring segment. Such a disposition enables the cooling air flow path within the bottom circuit B to be lengthened so as to increase heat transfer.

Figure 5:
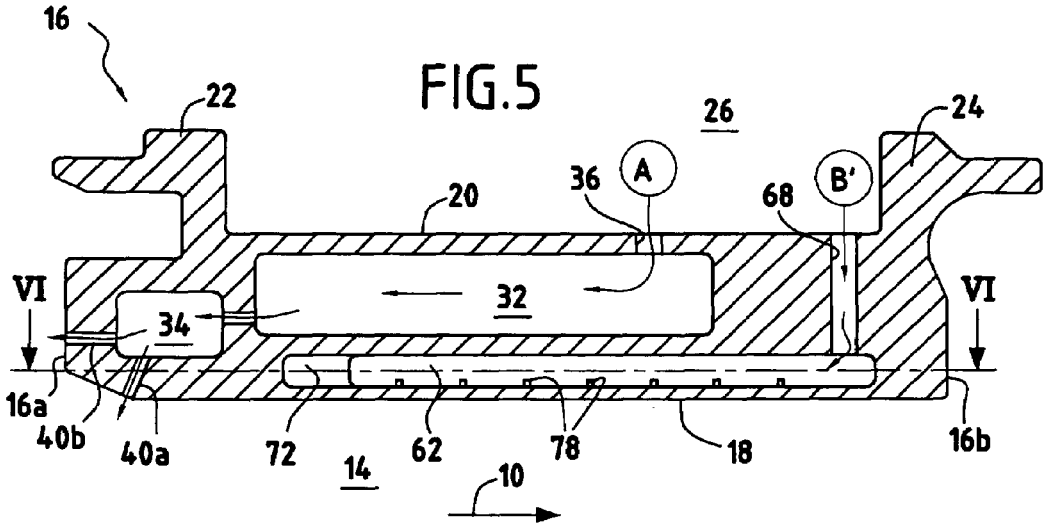
FIG. 5 is a longitudinal section view of a ring segment in another embodiment of the invention.

Another embodiment of the ring segment of the invention is described below with reference to FIGS. 5 and 6.

In this embodiment, the top cooling circuit A of the ring segment is identical to that described above. However the bottom cooling circuit B' is different.

The bottom cooling circuit B' comprises at least four internal cavities 58, 60, 62, and 64 which extend axially between the upstream and downstream transverse walls 16*a* and 16*b* of the ring segment 16.

These four cavities 58, 60, 62, and 64 are also radially offset relative to the first cavity 32 of the top cooling circuit A, i.e. they are disposed between the first cavity 32 of the top circuit A and the internal annular surface 18 of the ring segment 16.

The first cavity 58 of this bottom cooling circuit B' is disposed beside one of the longitudinal walls 16*c* (or 16*d*) of the ring segment 16. The second cavity 60 is offset circumferentially relative to the first cavity 58, the third cavity 62 is offset circumferentially relative to the second cavity, and the fourth cavity 64 is offset circumferentially relative to the third cavity. These cavities are disposed in such a manner that the fourth cavity 64 is disposed beside the longitudinal wall 16*d* (or 16*c*) opposite from the wall beside the first cavity 58.

At least first and second cooling air feed orifices 66 and 68 lead from the cooling chamber 26 into the second and third cavities 60 and 62 respectively in order to feed them with cooling air.

The bottom cooling circuit B' also has at least one first passage 70 putting the second cavity 60 into communication with the first cavity 58. Similarly, at least one second passage 72 puts the third cavity 62 into communication with the fourth cavity 64.

Finally, the bottom cooling circuit B' is provided with at least one plurality of first outlet holes 74 leading from the first cavity 58 into the hot gas passage 14 via the longitudinal wall 16*c* of the ring segment 16 located beside the first cavity 58.

Similarly, at least one plurality of second outlet holes 76 is provided leading from the fourth cavity 64 into the hot gas passage 14 via the other longitudinal wall 16*b* of the ring segment 16.

As a result, two mutually dependent bottom sub-circuits are obtained. As shown in FIG. 6, these sub-circuits may be substantially symmetrical relative to a middle longitudinal axis of the ring segment. These bottom sub-circuits are fed independently via the feed orifices 66 and 68, and they present independent outlet holes 74 and 76, serving to cool the ring segments adjacent to the ring segment in question.

The second and third cavities 60 and 62 of the bottom cooling circuit B' preferably include respective baffles 78 so as to increase heat transfer. These baffles 78 may be in the form of transversely-extending ribs (as in FIGS. 5 and 6), or of studs, or indeed of bridges.

Figure 6:
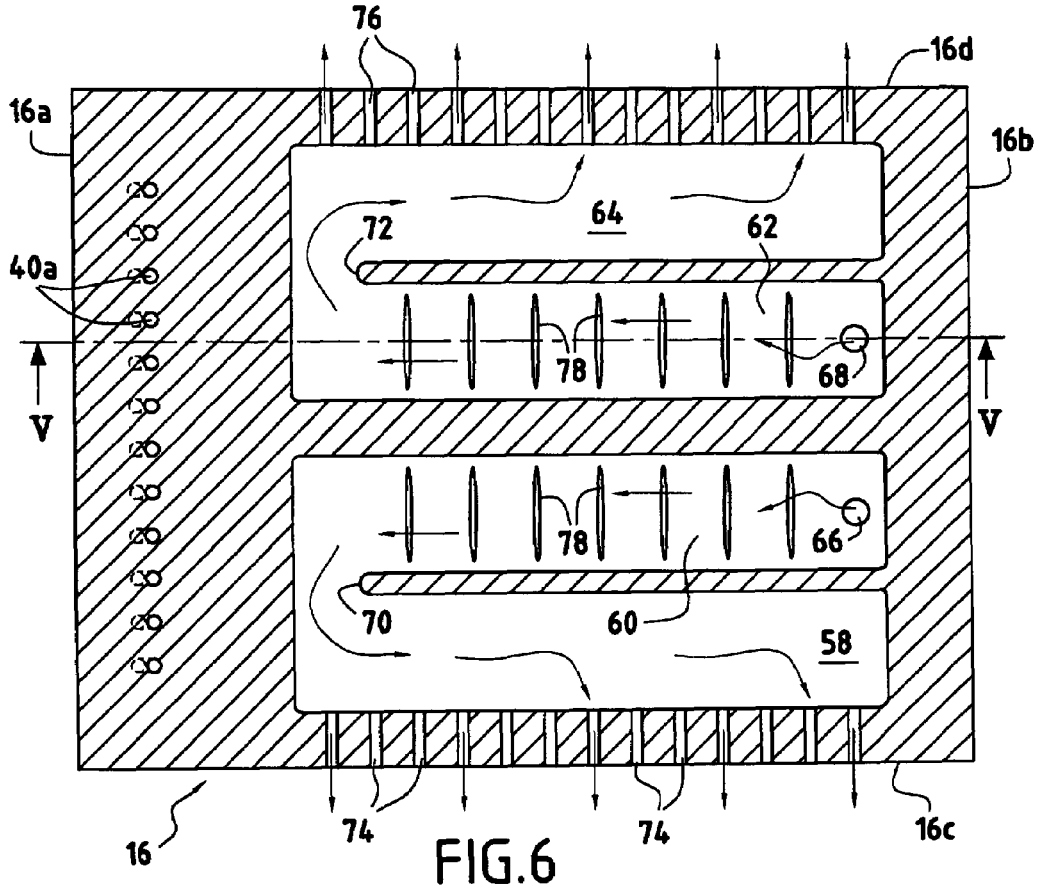
FIG. 6 is a section view on VI-VI of FIG. 5.

Furthermore, the first and second feed orifices 66 and 68 of the bottom circuit B' are advantageously formed beside one of the transverse walls 16*a*, 16*b* of the ring segment 16 (in FIG. 6 beside the downstream wall 16*b*), and the first and second passages 70 and 72 of the bottom circuit B' are formed beside the other transverse wall 16*b* or 16*a* of the ring segment 16 (in FIG. 6 beside the upstream wall 16*a*). This disposition serves to increase the cooling air flow path through the second bottom circuit B' in order to increase heat transfer.

The invention claimed is:

1. A stationary ring surrounding a hot gas passage of a gas turbine, the ring being surrounded by a stationary annular housing so as to co-operate therewith to define an annular cooling chamber into which there opens out at least one cooling air feed orifice, the ring comprising:

a plurality of ring segments, wherein each ring segment includes a top internal cooling circuit and a bottom internal cooling circuit, the bottom cooling circuit being independent of the top cooling circuit, and being radially offset relative to the top cooling circuit, and the bottom cooling circuit including at least one cooling air feed orifice leading from the cooling chamber, wherein said top cooling circuit includes at least one cooling air feed orifice leading from said cooling chamber.

2. A ring according to claim 1, wherein the top cooling circuit of each ring segment comprises:

at least one first internal cavity extending circumferentially between first and second longitudinal walls of the ring segment;

at least one second internal cavity extending circumferentially between the longitudinal walls of the ring segment and disposed axially upstream from the first cavity;

at least one cooling air feed orifice leading from the cooling chamber and into the first cavity to feed the first cavity;

a plurality of emission holes leading from the first cavity into the second cavity so as to cool the second cavity by air impact; and a plurality of outlet holes leading from the second cavity and into the hot gas passage at an upstream end of the ring segment.

3. A ring according to claim 1, wherein the bottom cooling circuit of each ring segment comprises:

at least one first internal cavity extending circumferentially between first and second longitudinal walls of the ring segment and disposed at a downstream end of the ring segment;

at least one second internal cavity extending circumferentially between the longitudinal walls of the ring segment and disposed axially upstream from the first cavity;

at least one third internal cavity extending circumferentially between the longitudinal walls of the ring segment and disposed axially upstream from the second cavity;

at least first and second passages respectively putting the first cavity into communication with the second cavity, and putting the second cavity into communication with the third cavity; and a plurality of outlet holes leading from the third cavity into the hot gas passage at an upstream end of the ring segment, the cooling air feed orifice leading into the first cavity to feed it with air.

4. A ring according to claim 3, wherein the second internal cavity of the bottom cooling circuit includes baffles to increase heat transfer.

5. A ring according to claim 3, wherein the air feed orifice and the second passage of the bottom cooling circuit are formed beside the first longitudinal wall of the ring segment, and the first passage of the bottom cooling circuit is formed beside the second longitudinal wall of the ring segment so as to increase the cooling air flow path length.

6. A ring according to claim 1, wherein the top cooling circuit of each ring segment comprises a portion of a top internal cavity such that said top internal cavity extends circumferentially around a longitudinal axis of said gas turbine, and wherein the bottom cooling circuit of each ring segment comprises a portion of a bottom internal cavity such that said bottom internal cavity extends circumferentially around said longitudinal axis of the gas turbine, wherein said top and bottom internal cavities are radially offset with respect to each other.

7. A ring according to claim 6, wherein the entirety of said bottom internal cavity is disposed between said top internal cavity and an internal annular surface of the ring segment, wherein said internal annular surface defines said hot gas passage of the gas turbine.

8. A ring according to claim 1, wherein said at least one cooling air feed orifice that opens out into said annular cooling chamber feeds said annular cooling chamber with cooling air, and wherein said annular cooling chamber feeds both said top and bottom internal cooling circuits with said cooling air.

9. A ring according to claim 8, wherein said cooling air fed to both said top and bottom internal cooling circuits includes a fraction of outside air passing through a fan of a turbomachine that includes the gas turbine and flowing around a combustion chamber of the turbomachine.

10. A ring according to claim 1, wherein said top cooling circuit primarily cools an upstream end of the ring segment, and wherein the bottom circuit primarily cools an inside surface of the ring segment.

11. A stationary ring surrounding a hot gas passage of a gas turbine, the ring being surrounded by a stationary annular housing so as to co-operate therewith to define an annular cooling chamber into which there opens out at least one cooling air feed orifice, the ring comprising:

a plurality of ring segments, wherein each ring segment includes a top internal cooling circuit and a bottom internal cooling circuit, the bottom cooling circuit being independent of the top cooling circuit, and being radially offset relative to the top cooling circuit, and the bottom cooling circuit including at least one cooling air feed orifice leading from the cooling chamber, wherein the bottom circuit cooling of each ring segment comprises:

at least one first internal cavity extending axially between upstream and downstream transverse walls of the ring segment and disposed besides one of first and second longitudinal walls of the ring segment;

at least one second internal cavity extending axially between the upstream and downstream transverse walls of the ring segment and being circumferentially offset relative to the first cavity;

at least one third internal cavity extending axially between the upstream and downstream transverse walls of the ring segment and being circumferentially offset relative to the second cavity;

at least one fourth internal cavity extending axially between the upstream and downstream transverse walls of the ring segment and being circumferentially offset relative to the third cavity;

at least first and second cooling air feed orifices leading from the cooling chamber into the second and third cavities respectively to feed the second and third cavities;

at least first and second passages putting respectively the second cavity into communication with the first cavity, and putting the third cavity into communication with the fourth cavity;

a plurality of first outlet holes leading from the first cavity into the hot gas passage through the first longitudinal wall of the ring segment beside which the first internal cavity is disposed; and a plurality of second outlet holes leading from the fourth cavity into the hot gas passage through the second longitudinal wall of the ring segment.

12. A ring according to claim 11, wherein each of the second and third internal cavities of the bottom cooling circuit includes baffles for increasing heat transfer.

13. A ring according to claim 11, wherein the first and second feed orifices of the bottom cooling circuit are formed beside the first transverse wall of the ring segment and the first and second passages of the bottom cooling circuit are formed beside the second transverse wall of the ring segment so as to increase the cooling air flow path length.

* * * * *